US005798683A

United States Patent [19]

Lin et al.

[11] Patent Number: 5,798,683

[45] Date of Patent: Aug. 25, 1998

[54] WATERPROOF FUSE PLUG INCLUDING A SAFETY FUSE DOOR & A FUSE PICK

[76] Inventors: Mei-Mei Lin; Li-Wen Liu, both of Suite 2, 7f, No. 95-8, Chang Ping Road, Sec. 1, Taichung, Taiwan

[21] Appl. No.: 684,566

[22] Filed: Jul. 19, 1996

[51] Int. Cl.[6] ..... H01H 85/02; H01R 13/68

[52] U.S. Cl. ..... 337/198; 337/186; 337/255; 337/260; 439/622

[58] Field of Search ..... 337/197, 198, 337/142, 186, 255, 256, 260; 439/621, 622

[56] References Cited

U.S. PATENT DOCUMENTS 5,435,755 7/1995 Chien et al. ..... 439/622

5,457,445 10/1995 Su ..... 337/198

*Primary Examiner*—Leo P. Picard

*Assistant Examiner*—Jayprakash N. Gandhi

[57] ABSTRACT

An improved fuse plug is provided. The fuse plug includes a housing, a pair of first and second fuse chambers formed in opposite side of the housing, a first blade directly connected with a first cord, a second blade indirectly connected with a second cord via a cartridge fuse disposed in the first fuse chamber, a stand-in cartridge fuse reserved in the second fuse chamber and both the fuse chambers are closed by a pair of waterproof safety fuse doors. A sleeve member made in conforming with the housing is sleeved on the housing and a fuse pick which is made from flexible plastic wraps on the cartridge fuse for facilitating a ready removal of the fuses from the chambers.

4 Claims, 5 Drawing Sheets

WATERPROOF FUSE PLUG INCLUDING A SAFETY FUSE DOOR & A FUSE PICK

BACKGROUND OF THE INVENTION

The present invention relates to fuse plugs and more particularly to an improved structure of a fuse plug having a fuse pick and a pair of safety fuse doors therein which are capable of waterproof and ready to pick up the fuse from the plug.

Typical fuse plug (as shown in FIGS. 1, 2 and 2A) comprises a casing 10, a first blade 11 directly connected to a first cord 12, a second blade 13 symmetrically secured in a front end of the casing 10 having a transverse portion inserted into the forward end of a fuse chamber 14, a copper plate (not shown) at the other end of the chamber 14 connected to a second cord 15 and a fuse door 16 slidably covering the chamber 14 after a cartridge fuse 17 disposed into the chamber 14. The cartridge fuse 17 is adapted to engage the second blade 13 with the second cord 15 via the copper plate. This arrangement provides a great protection to an electrical plug for preventing it from an overload. Besides a stand-in cartridge fuse attaches to the cord thereon adjacent the rear end of the casing 10 for facilitating a timely replacement of the fuse. FIGS. 3 and 3A show another typical fuse plug which has fuse chamber 14' in the center of front portion for disposition of a pair of smaller cartridge fuses, a fuse door closed the chamber 14', a pair of socket eyelets 18 in the rear end and a pair of cords 12' and 15' indirectly connected with the first and the second blades 11' and 13' via the pair of fuses. However, these fuse plugs have the common disadvantages such as that the fuse door 16 is too short to prevent an electric shock and lacks the waterproof arrangement. A pair of protrudent guide 161 on under side of the housing 10 and 10' causing an obstacle to open the door 16 and 16' and that a cylinder shaped cartridge fuse disposed in the fuse plug is difficult to pick up for replacement.

SUMMARY OF THE PRESENT INVENTION

The present invention has a main object to provide an improved structure of a fuse plug which has a fuse chamber formed in each of the opposite sides for receiving both an active and a stand-in cartridge fuse.

Another object of the present invention is to provide an improved structure of a fuse plug which has an improved safety fuse door having waterproof arrangement thereon to prevent the water from permeated into the plug and an extension to protect the user from getting an electric shock.

Still another object of the present invention is to provide an improved structure of a fuse plug having adapted a fuse pick to readily pick up the cartridge fuse from the fuse plug.

The present invention will become more fully understood by reference to the following detailed description thereof when read in conjunction with the attached drawings.

DETAILED DESCRIPTION OF THE PREFERRED EMBODIMENT

Figure 1:
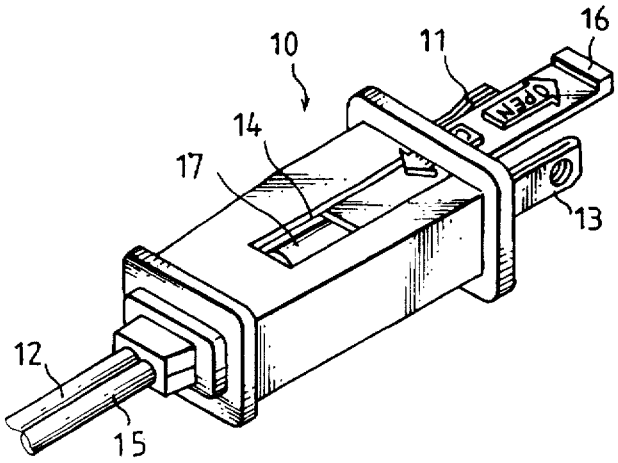
PRIOR ART FIG. 1
FIG. 1 is a perspective view to show a fuse plug of a prior art.
Figure 2:
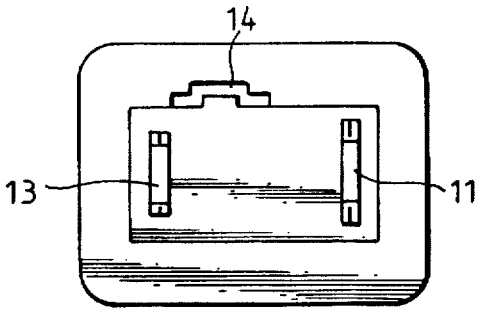
PRIOR ART FIG. 2
FIGS. 2 and 2A are a sectional view and a perspective view to show a fuse plug of a prior art.
Figure 2A:
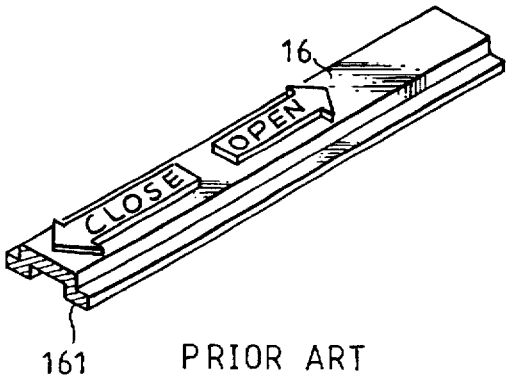
PRIOR ART FIG. 2A
Figure 3A:
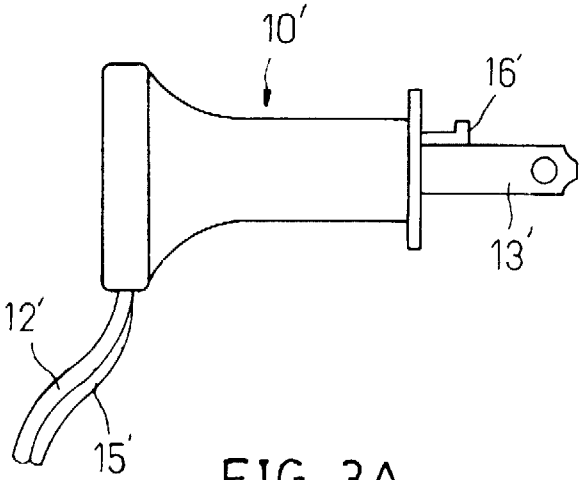
FIG 3A PRIOR ART
FIGS. 3 and 3A are the perspective views to show a fuse plug of another prior art.
Figure 3:
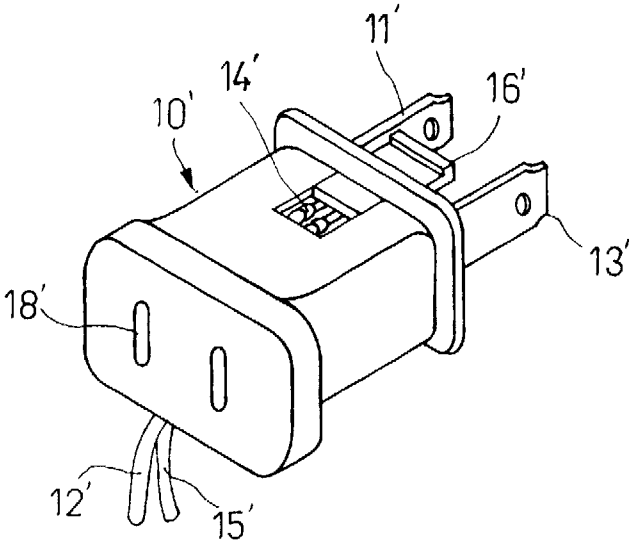
FIG 3 PRIOR ART
Figure 4:
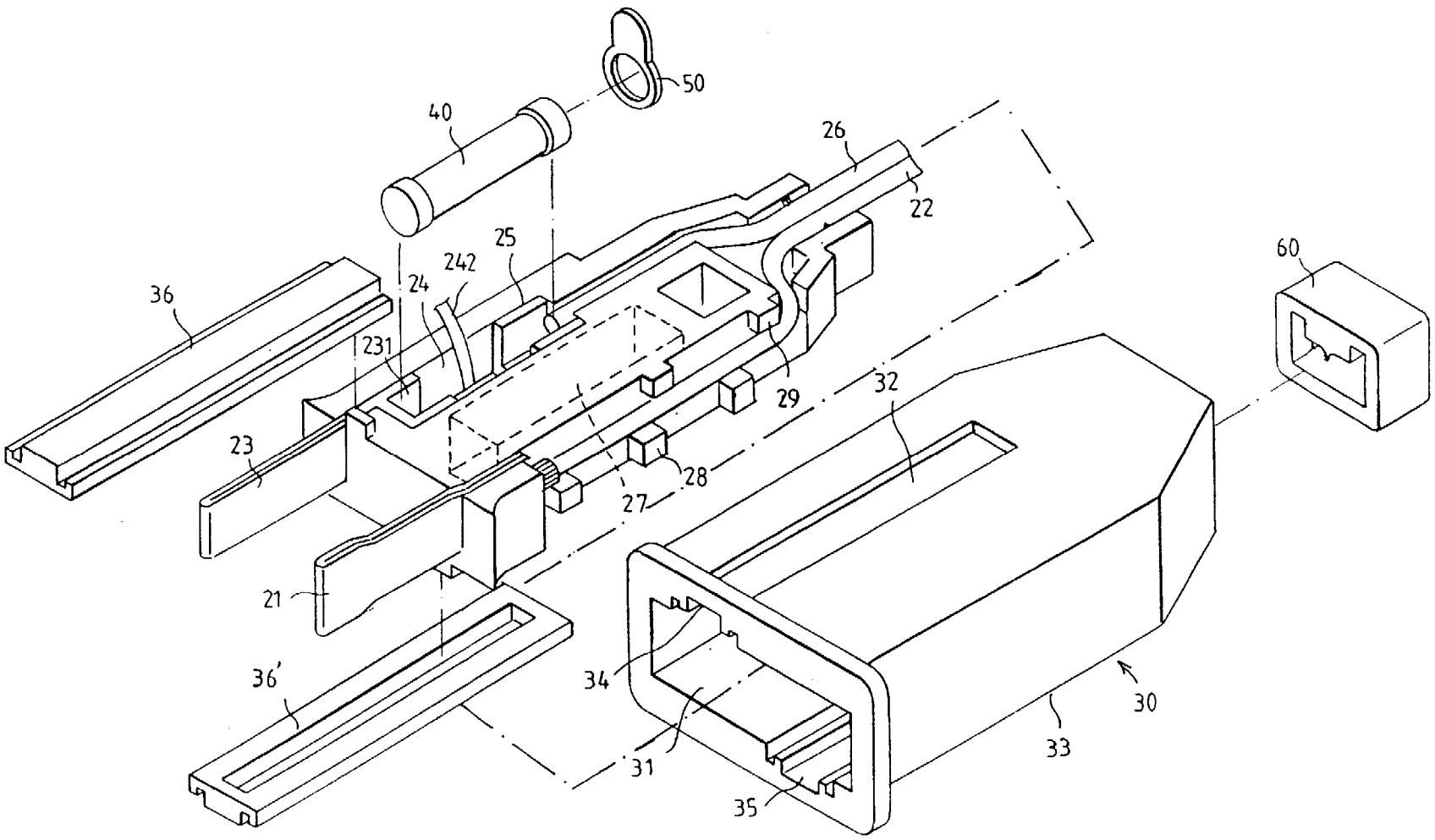
FIGS. 4 and 4A are a perspective view and a sectional view to show a preferred embodiment of the present invention.
Figure 4A:
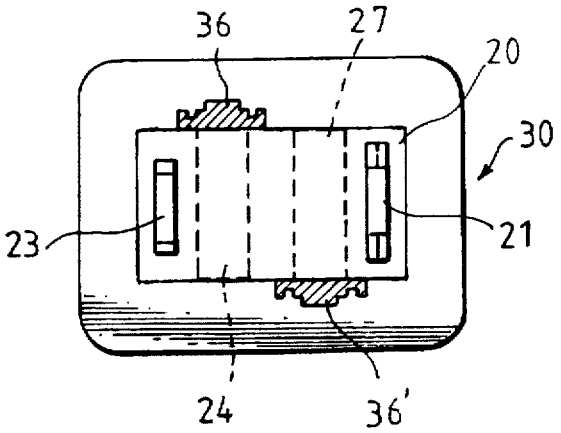

With reference to FIGS. 4 and 4A, the fuse plug of the present invention comprises a housing 20, a first conductor blade 21 secured into a front end and directly connected with a first cord 22, a second conductor blade 23 symmetrically secured into the housing 20 parallel to the first conduct plate 21 and including a transverse portion 231 of L-shaped section disposed at the fore end of a first fuse chamber 24 which is provided to receive an active cartridge fuse 40 therein, a U-shaped copper plate 25 connected to a second cord 26 and disposed at the rear end of the first fuse chamber 24, a second fuse chamber 27 for receiving a stand-in cartridge fuse 40' formed in the opposite side of the housing 20 symmetrical to the first fuse chamber 24 and a plurality of first projections 28 extended outward from along the opposite lateral sides of the housing 20 for friction engaging purpose and a pair of projections 29 extended outward from an inner wall of the housing 20 for securing the first cord 22 and a sleeve member 30 sleeved on the housing 20 and composed of a rectangular opening 31 in the forward end made in conforming with the front end of the housing 20, a pair of rectangular slots 32 and 33 formed in the opposite sides made in registry with the chambers 24 and 27 of the housing 20, a pair of entrance 34 and 35 symmetrically formed in the upper and lower edges of the opening 31 and a pair of safety fuse doors 36 and 36' slidably covered the fuse chambers 24 and 27 when the fuses 40 are disposed therein. The fuse chambers 24 and 27 each has a piece of tape 242 and 272 for facilitating removal of the fuses 40 from the housing 20. Besides, a fuse pick 50 for readily removing the fuse 40 and 40' from the fuse chambers 24 and 27 is wrapped onto the inward end of the fuse 40 and a collapsible waterproof sleeve member 60 is sleeved on the cords 22 and 26 adjacent the rear end of the sleeve member 30 to prevent the rear portion of the fuse plug from permeated with water.

Figure 5:
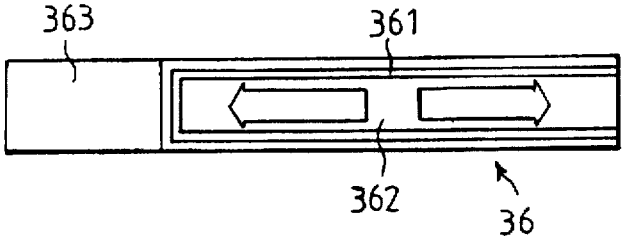
FIGS. 5 and 5A are a sectional view and a top view to show the safety fuse door of the present invention.
Figure 5A:
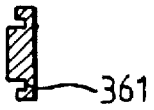

Referring to FIGS. 5 and 5A, the safety fuse door 36 comprises an elongate flat body of the length equal or less to the length of the fuse chambers 24 and 27 and the conductor blades 22 and 26, a U-shaped slot 361 formed around an upper surface including arrows 362 enclosed therein and an extension 363 for preventing an electric shock extended outward from one end of the body. This arrangement ensures the security that the fuse in the chamber would have been completely covered before the plug has electricity, even the door is not yet in right position in the chamber 241. When the safety fuse doors 36 and 36' are slid into chambers 24 and 27, their extensions 363 will insert deeply into the rear portion of the fuse plug, in addition to the U-shaped slot 361 which can divert water from leaking into the fuse chambers 24 and 27, so that this safety fuse doors 36 and 36' can prevent the user from getting an electric shock and provide a waterproof function to the plug housing 20. The flat surfaced under side of the fuse door 36 and 36' will no longer cause obstacle to the closing or opening activities.

Figure 6:
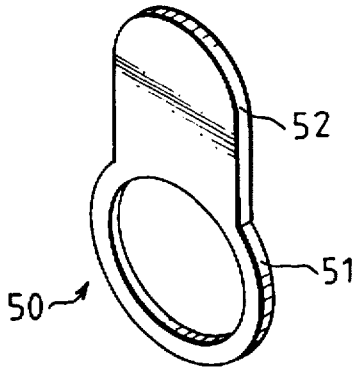
FIG. 6 is a perspective view to show a fuse pick of the present invention.
Figure 7:
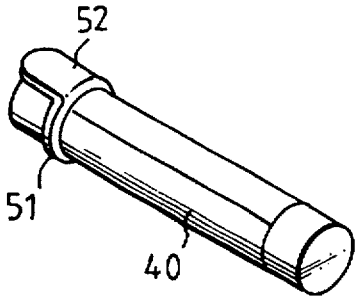
FIG. 7 is a perspective view to show a fuse pick of FIG. 6 wrapped on a cartridge fuse where the tab covers on one of the copper ends of the fuse.

Referring to FIGS. 6 and 7, a fuse pick 50 of the present invention is shown. FIG. 6 shows a fuse pick 50 which is made of flexible plastic and comprises an annular ring 51 of a diameter slightly larger than the diameter of the cartridge fuse 40 and a tab 52 extended outward from a periphery of the ring 51. Before disposing of the cartridge fuse 40 into the chambers 24 and 27, the fuse pick 50 is wrapped on the fuse 40 adjacent the rear end thereof (as shown in FIG. 7). When the safety fuse doors 36 and 36' slide into the chambers 24 and 27, the extension 363 of the doors 36 and 36' will press the tab 52 collapsing down to cover on the copper end of the fuse 40. So that this arrangement provides an additional protection to prevent the of the fuse 40 from exposed to outside of the chambers 24 and 27 causing an electric shock to the user. When opens the fuse doors 36 and 36', the tab 51 of the pick 50 will stand up automatically to facilitate a ready removal of the cartridge fuse 40 from the fuse chambers 24 and 27.

Note that the specification relating to the above embodiment should be construed as exemplary rather than as limitative of the present invention, with many variations and modifications being readily attainable by a person of average skill in the art without departing from the spirit or scope thereof, as defined by the appended claims and their legal equivalents.

We claim:

1. A fuse plug comprising:

a plug having a housing, a first conductor blade secured to a front end of said housing and directly connected with a first cord, a second conductor blade symmetrical to the first conductor blade and including a first transverse portion of L-shaped section disposed into a forward end of a first fuse chamber for receiving an active cartridge fuse formed in one side of said housing, a U-shaped copper plate disposed into a rearward end of said first fuse chamber and connected with a second cord parallel to said first cord, a second fuse chamber for receiving a stand-in cartridge fuse formed in an opposite side of said housing, a plurality of first projections for friction engagement extended outward from along opposite lateral sides of the housing and a pair of second projections for securing said first cord extended outward from an inner wall thereof;

a sleeve member sleeved on said housing and comprising a rectangular opening in an fore end made in conforming with a forward end of said housing, a pair of rectangular slots formed in opposite sides of said sleeve member made in registry with said pair of chambers of the housing and a pair of entrance symmetrically formed in upper and lower edges of said rectangular opening;

a collapsible waterproof sleeve member sleeved on the cords adjacent a rear end of said housing;

a pair of safety fuse doors slidably closed said first and second fuse chambers of the housing respectively, said fuse doors each comprising an elongate flat body of the length equal to the length of said fuse chambers and the conductor blades, a U-shaped slot for waterproof formed in an upper surface and an extension for preventing an electric shock extended inwardly from an inward end thereof.

2. A fuse plug according to claim 1 further comprising a fuse pick wrapped on one end said cartridge fuse, said fuse pick is an annular ring having a tab extended outward from a periphery thereof.

3. A fuse plug according to claim 2 wherein said fuse pick is made from flexible plastic.

4. A fuse plug according to claim 1 further comprises a tape disposed in said first and second fuse chambers for a ready removal of said cartridge fuses from therein.

* * * * *